US006543577B1

(12) United States Patent
Ferreira et al.

(10) Patent No.: US 6,543,577 B1
(45) Date of Patent: Apr. 8, 2003

(54) SILENCER

(76) Inventors: Stephanus Ferreira, 32 Acacia Street, Golf Park, Meyerton, 1961 (ZA); Bevan John Davis, 5 Denham Road, Denham Green, Lakefield, Benoni, 1501 (ZA)

( * ) Notice: Subject to any disclaimer, the term of this patent is extended or adjusted under 35 U.S.C. 154(b) by 0 days.

(21) Appl. No.: 09/554,702

(22) PCT Filed: Nov. 20, 1998

(86) PCT No.: PCT/GB98/03490

§ 371 (c)(1),
(2), (4) Date: Jul. 18, 2000

(87) PCT Pub. No.: WO99/27238

PCT Pub. Date: Jun. 3, 1999

(30) Foreign Application Priority Data

Nov. 21, 1997 (ZA) ..... 97/10503

(51) Int. Cl.[7] ..... F01N 7/18

(52) U.S. Cl. ..... 181/282; 181/243; 181/246; 181/252

(58) Field of Search ..... 181/252, 256, 181/243, 246, 249, 255, 282; 277/590, 591, 592, 597, 627, 931

(56) References Cited

U.S. PATENT DOCUMENTS 3,095,944 A * 7/1963 Buxton ..... 181/243
4,045,057 A * 8/1977 Halter ..... 181/282
4,239,091 A 12/1980 Negrao
4,244,442 A * 1/1981 Scarton et al. ..... 181/243
4,880,078 A * 11/1989 Inoue et al. ..... 181/282
4,993,513 A * 2/1991 Inoue et al. ..... 181/282
5,033,580 A 7/1991 Acerbis
5,330,200 A * 7/1994 Unseth ..... 277/591
5,340,952 A * 8/1994 Takiguchi ..... 181/282
5,516,120 A * 5/1996 Damusis ..... 277/591

FOREIGN PATENT DOCUMENTS

DE 43 26 304 C1 1/1994
EP 0 446 064 A2 9/1991

* cited by examiner

*Primary Examiner*—Khanh Dang
(74) *Attorney, Agent, or Firm*—Alston & Bird LLP

(57) ABSTRACT

A silencer (10) includes a polymeric casing (12) spaced from at least one inlet pipe and at least one outlet pipe by polymeric spacers (52). The polymeric spacers are made from a different material to that of the polymeric casing. The polymeric spacers are heat-resistant and have a higher melting point than the polymeric casing. The polymeric spacers are made of a softer material than the polymeric casing, and the polymeric spacers are capable of being deformed to accommodate irregularities in the shape of the inlet and outlet pipes.

13 Claims, 2 Drawing Sheets

SILENCER

BACKGROUND TO THE INVENTION

THIS invention relates to a silencer for a motor vehicle.

Free flow exhaust systems are widely used in the motor industry as they tend to improve the performance of a motor vehicle when compared to conventional exhaust systems. A drawback associated with free flow exhaust systems, however, is that the exhaust noise levels are considerably higher than for conventional exhaust systems, and are often higher than legal limits.

Attempts have been made to provide silencers or mufflers to reduce the noise of free flow exhaust systems to acceptable levels. Traditionally, this has entailed providing an elongate silencer which is positioned around a perforated section of the exhaust pipe to dampen the noise levels. As with conventional silencers, these free flow exhaust silencers are made from stainless steel or similar metallic materials. As a result, they generally have to be fitted by specialist fitters. They are also susceptible to corrosion and generally have to be replaced fairly often.

SUMMARY OF THE INVENTION

According to the invention a silencer includes a polymeric casing connected to at least one inlet pipe and to at least one outlet pipe by polymeric spacers.

The polymeric spacers are preferably heat-resistant, preferably have a higher melting point than the polymeric casing, are preferably made of a different material to that of the polymeric casing, are preferably flexible relative to the polymeric casing and are preferably softer than the polymeric casing.

The polymeric spacers are capable of deformation to accommodate irregularities in the shape of the inlet and/or outlet pipes.

The inlet and outlet pipes are preferably made of metal which is preferably steel.

The casing preferably has collars, with the polymeric spacers being located between the collars and the inlet and outlet pipes. The housing preferably narrows towards the collars.

A sealant may be interposed between the polymeric spacers and their respective inlet and outlet pipes.

Preferably the polymeric spacers anchor the casing to the inlet and outlet pipes.

The polymeric spacers may be made from polytetrafluoroethylene.

The housing may include two sections secured to one another.

The two sections are preferably secured to one another by a connector. The two sections and the connector may have clip formations so that the two sections can be clipped to the connector. The connector may be a spacer to increase the length of the housing. Preferably the two sections are identical. Each section may include an integrally formed collar.

The polymeric casing is preferably made of a glass filled nylon.

The inlet and outlet pipes preferably form part of a continuous pipe which extends through the housing, with at least part of the continuous pipe located within the housing being perforated. Insulating material preferably surrounds the continuous pipe. The insulating material may be a continuous length of glass wool wrapped around the continuous pipe.

The silencer may however have a plurality of inlet and outlet pipes. The inlet and outlet pipes may be formed by a plurality of continuous pipes extending through the housing, with at least part of each continuous pipe located within the housing being perforated.

BRIEF DESCRIPTION OF THE ACCOMPANYING DRAWINGS

The invention will now be described by way of non-limiting examples with reference to the accompanying drawings in which.

DESCRIPTION OF THE PREFERRED EMBODIMENTS

Figure 1:
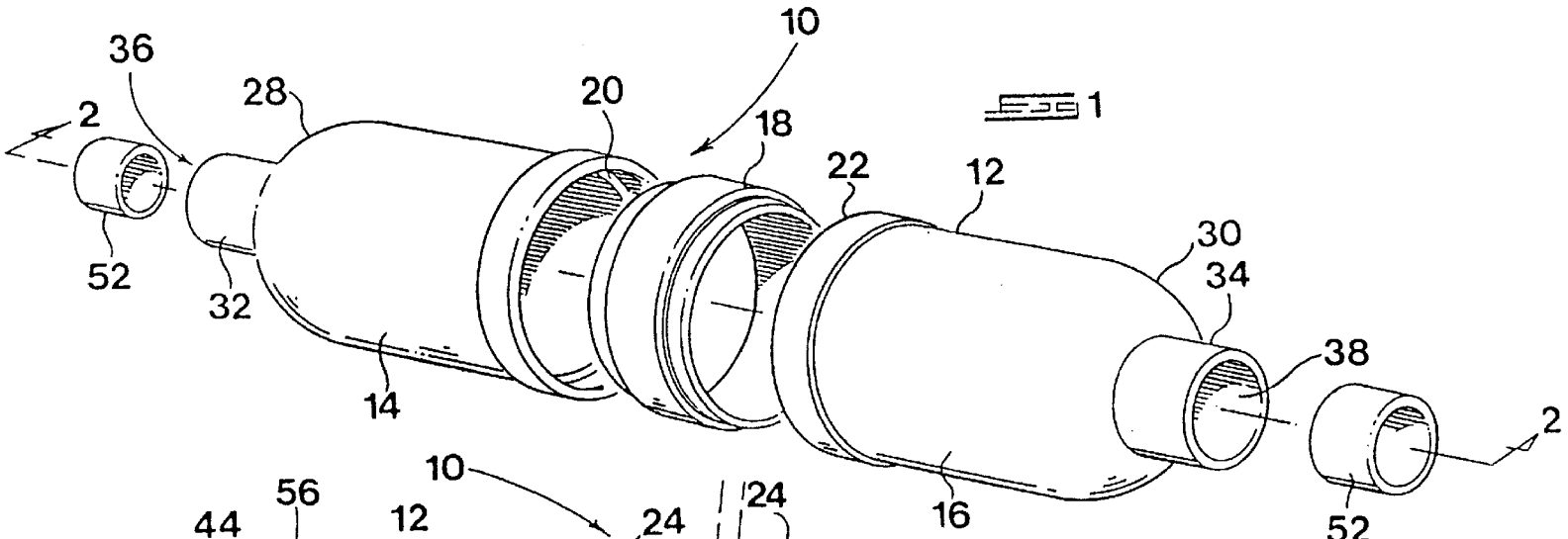
FIG. 1 is an exploded, perspective view of a silencer according to the invention.

A composite silencer 10 includes a nylon casing 12 of a three piece construction. The nylon casing 12 consists of two identical sections 14 and 16 connected together by a connector 18. The connector is positioned between openings 20 and 22 of the sections 14 and 16.

The two sections 14 and 16 and the connector 18 are clipped together via complementary clip formations 24 and 26. The clip formations 24 on the sections 14 and 16 are in the form of ring-like projections or lips surrounding openings 20 and 22. The clip formations 26 on the connector 18 are in the form of complementary receiving channels. Although this clip arrangement is preferred, it is envisaged that other appropriate arrangements such as male and female formations or bayonet-type formations could be used so that the two sections can be connected directly to one another.

Each of the sections 14 and 16 have integrally formed end walls 28 and 30, respectively, which narrow towards annular collars 32 and 34, respectively. The collars 32 and 34 have apertures 36 and 38 which are axially aligned and which allow an elongate exhaust pipe 40 to extend through the nylon casing 12. The exhaust pipe 40 has perforations 42 to allow exhaust gas passing through the exhaust pipe 40 to enter a chamber 44 defined by the casing 12.

Figure 2:
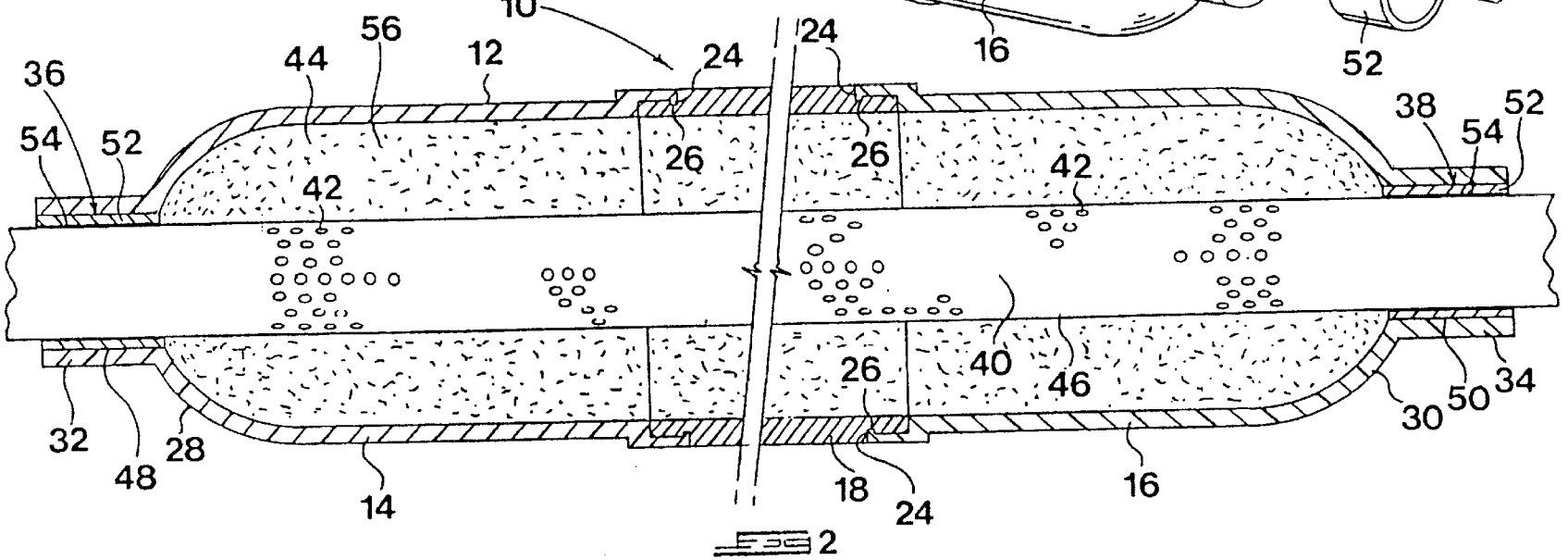
FIG. 2 is a cross-sectional view on line 2—2 of the silencer of FIG. 1, fitted to a section of exhaust pipe.
Figure 3:
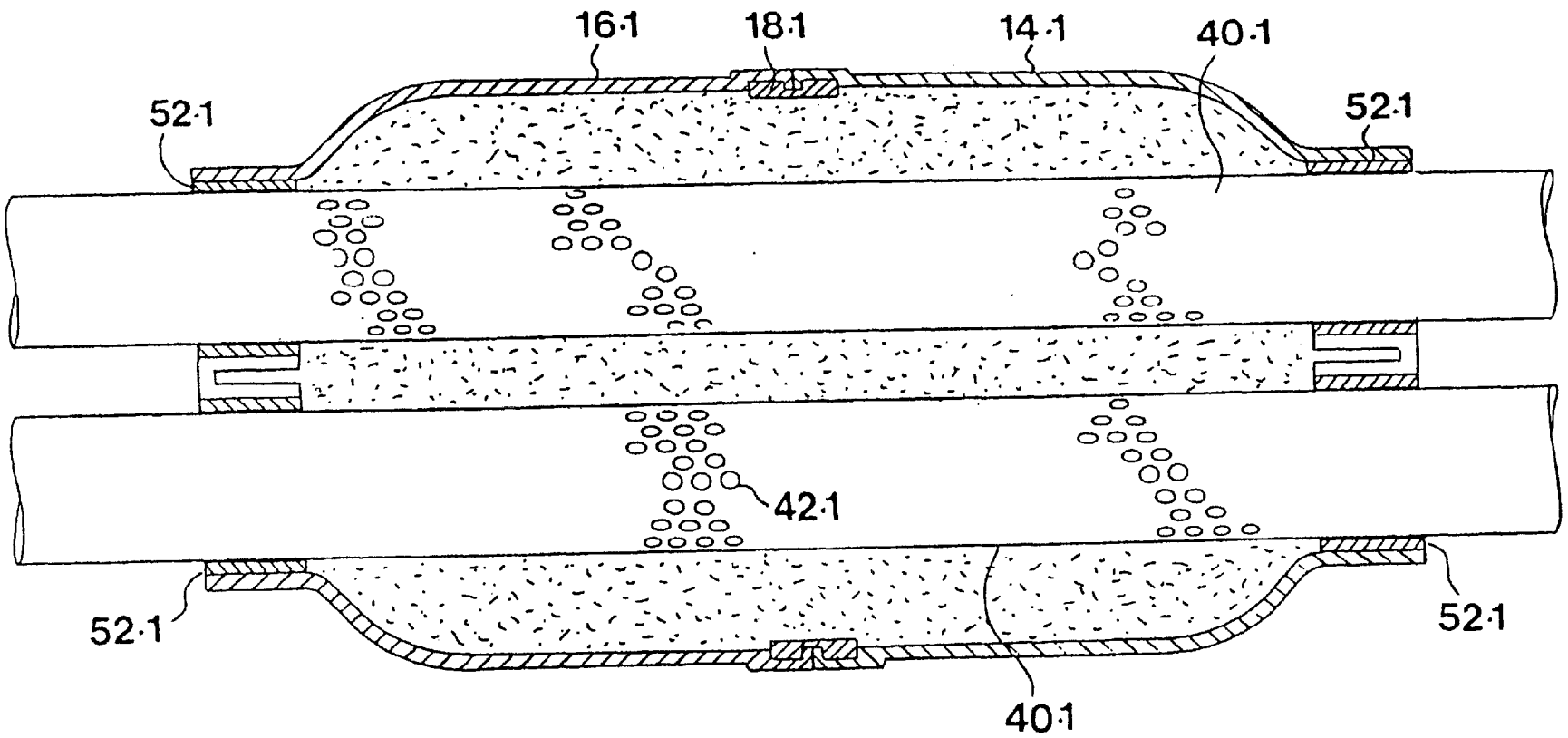
FIG. 3 is a cross-sectional plan view of a silencer with twin exhaust pipes.

Although this embodiment relates to a single, straight exhaust pipe 40, other exhaust pipe configurations can be used. As shown in FIG. 3, two exhaust pipes pass through the casing. In FIG. 3, the suffix 1 is used for parts corresponding to those FIGS. 1 and 2. However the exhaust pipe configuration could consist of a single pipe entering the casing from one end, branching into two pipes via a Y-branch, the two branched pipes exiting the casing through the opposite end. Alternatively, this configuration can be reversed so that two exhaust pipes enter the casing with a single exhaust pipe exiting the casing. In each of these configurations, the respective casing sections 14 and 16 are adapted to accommodate the different configurations. The sections 14 and 16 and the connector 18 are injection moulded from a glass filled nylon material known as nylon 66. This material consists of approximately 60 to 65% nylon and approximately 30 to 35% glass. Although it is envisaged that any other suitable heat resistant polymeric material may be used, nylon 66 is preferred because of its heat resistant properties. It can withstand working temperatures ranging from about −70° C. up to about 200° C., and has a melting point of 261° C. It is also highly shock absorbent and is therefore able to withstand vibrations and other body fatigue during use. The polymeric material absorbs sound to a greater extent than stainless steel, because it is less dense.

Located between an outer surface 46 of the exhaust pipe 40 and inner walls 48 and 50 of the collars 32 and 34, respectively, are a pair of heat resistant spacers in the form of bushes 52. The bushes 52 are formed of a heat resistant polymeric material, in this case polytetrafluoroethylene (P.T.F.E.). The bushes 52 are pressed into position and form an interference fit between the inner walls 48 and 50 of the collars, and between the bores of the bushes 52 and the exhaust pipe 40. The bushes 52 substantially seal the ends of the chamber 44 and provide resistance to heat transfer from the exhaust pipe 40 to the casing 12 from hot exhaust gases passing through the exhaust pipe 40. Silicon sealant 54 is provided between the bushes and the exhaust pipe 40. This is necessary in certain situations as the bushes 52 and the casing 12 expand under heat. Since they have different heat expansion co-efficients, expansion of these components may result in gases leaking from the chamber 44, which is undesirable. The seals between the bushes and the collars and between the bushes and the exhaust pipe have withstood pressures of up to two bar above atmospheric pressure without leaking.

Although it is envisaged that other materials can be used for the bushes 52, P.T.F.E bushes are preferred because of their heat resistant properties. The P.T.F.E bushes 52 have a working temperature ranging from about −269° C. to about 270° C., and have a melting point of about 380° C. The P.T.F.E. bushes can withstand heat spikes of up to 330° C., and is believed that they can withstand heat spikes of up to 370° C. This material therefore has the ability to withstand the high temperatures of the stainless steel exhaust and resist heat transfer to the casing 12. In addition, the bushes 52 are flexible and soft relative to the casing 12. The bushes 52 are therefore capable of deformation to conform to irregularities in the shape of the exhaust pipe 40 which may not be perfectly round.

A continuous length of glass wool 56 is wrapped around the exhaust pipe 40 within the chamber 44 to provide additional damping or muffling of the exhaust noise. The glass wool can withstand temperatures of up to 700° C.

Connectors 18 of variable widths can be used. As a result, the overall length of the casing 12 can be adjusted by using connectors 18 of different widths. This allows a user to change the length of the casing to suit a particular motor vehicle by simply changing a single part. The connectors 18 of different widths are colour coded to simplify the choice of connector 18.

The applicant envisages that the silencer 10 may be offered for sale in the form of a kit comprising the identical sections 14 and 16, at least one connector 18, the bushes 52, glass wool, and the stainless steel perforated exhaust pipe section 40. The kit can be readily assembled by winding the glass wool around the exhaust pipe 40, positioning the bushes 52 within the respective collars 32 and 34, sliding the two sections 14 and 16 over the pipe 40 with the connector 18 positioned between them, and clipping the pieces together. Typically, where additional sealing is required, the silicon sealant 54 will be put in place prior to clipping the pieces together. A section of an existing exhaust pipe is then replaced by the exhaust pipe 40 with the assembled silencer 10 fitted thereto. Alternatively, the silencer may be assembled in situ on an existing exhaust pipe that has been perforated.

The silencer according to the invention is believed to have a number of advantages over conventional stainless steel mufflers. Because the silencer of the invention is made from nylon, which is less dense than stainless steel, it tends to dampen or muffle sound to a greater extent than stainless steel. Further, the simple, yet effective, manner of clipping the various pieces together and frictionally fitting it to the free flow exhaust pipe will enable a user to fit the silencer a do-it-yourself (DIY) manner. No welding or special adhesives are required to assemble the silencer or fit it to the exhaust pipe. In addition, the user can vary the length of the silencer, to suit a particular make of vehicle, by interchanging connectors of different widths. Further, the silencer is smaller than conventional silencers because of the excellent noise dampening qualities of the nylon, and the silencer is between 35% and 55% lighter than equivalent steel exhausts.

It will be appreciated that many modifications or variations of the invention are possible without departing from the spirit or scope of the invention.

What is claimed is:

1. A silencer, comprising:

a polymeric casing defining a chamber and having a first portion defining an inlet and a second portion defining an outlet;

an exhaust gas inlet pipe extending through the inlet into the polymeric casing for conveying exhaust gas into the polymeric casing, the inlet and the exhaust gas inlet pipe cooperating to define a first gap therebetween;

an exhaust gas outlet pipe extending out of the polymeric casing through the outlet for conveying exhaust gas from the polymeric casing, the outlet and the exhaust gas outlet pipe cooperating to define a second gap therebetween;

a polytetrafluoroethylene bushing pressed into each of the first and second gaps so as to be secured in an interference fit between the inlet and outlet of polymeric casing and the exhaust gas inlet and outlet pipes, respectively, so as to provide resistance to heat transfer therebetween and to provide exhaust gas seals for the chamber.

2. A silencer according to claim 1 wherein the first and second portions of the polymeric casing, defining the inlet and outlet, respectively, are configured as collars.

3. A silencer according to claim 1 wherein the polymeric casing consists of two substantially identical sections secured together.

4. A silencer according to claim 3 wherein the two substantially identical sections are secured together by a connector.

5. A silencer according to claim 1 wherein an insulating material is disposed within the polymeric casing.

6. A silencer according to claim 5 wherein the insulating material is glass wool.

7. A silencer according to claim 1 wherein the polymeric casing is made of a glass filled polymer.

8. A silencer according to claim 7 wherein the glass filled polymer is glass filled nylon.

9. A silencer according to claim 1 wherein the exhaust gas inlet and outlet pipes each form part of a continuous exhaust gas pipe extending through the polymeric casing, with a portion of the continuous exhaust gas pipe disposed between the inlet and outlet being perforated.

10. A silencer, comprising:

a polymeric casing defining a chamber and having a first portion defining an inlet and a second portion defining an outlet;

an exhaust gas inlet pipe extending through the inlet into the polymeric casing for conveying exhaust gas into the polymeric casing, the inlet and the exhaust gas inlet pipe cooperating to define a first gap therebetween;

an exhaust gas outlet pipe extending out of the polymeric casing through the outlet for conveying exhaust gas from the polymeric casing, the outlet and the exhaust gas outlet pipe cooperating to define a second gap therebetween;

a polymeric bushing configured to be flexible with respect to the polymeric casing, the polymeric bushing being pressed into each of the first and second gaps so as to be secured in an interference fit between the inlet and outlet of polymeric casing and the exhaust gas inlet and outlet pipes, respectively, so as to provide resistance to heat transfer therebetween and to provide exhaust gas seals for the chamber.

11. A silencer according to claim 10 wherein the inlet and outlet bushings are configured as right circular cylindrical sleeves.

12. A silencer, comprising:

a polymeric casing defining a chamber and having a first portion defining an inlet and a second portion defining an outlet;

a continuous exhaust gas pipe, extending through the inlet into the polymeric casing and out of the polymeric casing through the outlet, for conveying exhaust gas into and out of the polymeric casing, a portion of the exhaust gas pipe between the inlet and the outlet being perforated, the inlet and the exhaust gas pipe cooperating to define a first gap therebetween and the outlet and the exhaust gas pipe cooperating to define a second gap therebetween;

a polytetrafluoroethylene bushing pressed into each of the first and second gaps to as to be secured in an interference fit between the inlet and outlet of polymeric casing and the exhaust gas pipe so as to provide resistance to heat transfer therebetween and to provide exhaust gas seals for the chamber.

13. A silencer, comprising:

a polymeric casing defining a chamber and having a first portion defining an inlet and a second portion defining an outlet;

an exhaust gas inlet pipe extending through the inlet into the polymeric casing for conveying exhaust gas into the polymeric casing;

an exhaust gas outlet pipe extending out of the polymeric casing through the outlet for conveying exhaust gas from the polymeric casing; and a polymeric spacer configured to be flexible relative to the polymeric casing, the polymeric spacer being pressed between each of the exhaust gas inlet and outlet pipes and the inlet and outlet of the polymeric casing, respectively, so as be secured in an interference fit to provide spacing and resistance to heat transfer therebetween and to provide exhaust gas seals for the chamber.

* * * * *